US005562333A

United States Patent [19]

Domenig et al.

[11] Patent Number: 5,562,333

[45] Date of Patent: Oct. 8, 1996

[54] BRACKET FOR USE IN A CABINET OR SIMILAR FURNITURE ARTICLE WITH A FALSE DRAWER FRONT AND WITH A DRAWER GUIDE HAVING A TONGUE PORTION

[75] Inventors: Georg Domenig; Rick Marsh, both of Kernersville, N.C.

[73] Assignee: Grass America, Inc., Kernersville, N.C.

[21] Appl. No.: 388,716

[22] Filed: Feb. 15, 1995

[51] Int. Cl.[6] ..... A47B 88/00

[52] U.S. Cl. ..... 312/348.1; 248/201

[58] Field of Search ..... 248/201; 312/348.1, 312/204, 286, 287, 289, 348.4

[56] References Cited

U.S. PATENT DOCUMENTS

| | | | |
|---|---|---|---|
| 3,738,726 | 6/1973 | Burst et al. | 312/204 X |
| 3,979,796 | 9/1974 | MacDonald | 24/336 |
| 4,037,897 | 7/1977 | Siggia | 312/343 |
| 4,141,525 | 2/1979 | Miller | 248/251 |
| 4,278,309 | 7/1981 | Dreiling | 312/343 |
| 5,039,181 | 8/1991 | Lautenschlager | 312/343 |
| 5,387,033 | 2/1995 | Domenig | 312/334.5 |
| 5,466,060 | 11/1995 | Hoffman | 312/334.8 |

*Primary Examiner*—Peter M. Cuomo
*Assistant Examiner*—Robert J. Sandy
*Attorney, Agent, or Firm*—Petree Stockton, LLP

[57] ABSTRACT

A bracket for use in a cabinet or similar furniture article with a false drawer front opening and with a drawer guide has a base attachable to a false drawer front and an engaging member upstanding from the base with a locking projection lockable in the false drawer front opening of the cabinet or furniture article and a support element upstanding from the base provided with at least one support post engageable by a tongue portion of the drawer guide.

10 Claims, 3 Drawing Sheets

BRACKET FOR USE IN A CABINET OR SIMILAR FURNITURE ARTICLE WITH A FALSE DRAWER FRONT AND WITH A DRAWER GUIDE HAVING A TONGUE PORTION

BACKGROUND OF THE INVENTION

1. Field of the Invention

The present invention relates to brackets for mounting false drawer fronts on cabinets or similar furniture articles and with a drawer guide having a tongue portion and more particularly to a new and improved bracket including a base attachable to a false drawer front and which has at least one upstanding leg with portions defining a locking projection lockable in a false drawer front opening of a cabinet or similar furniture article and which also has at least one upstanding support element with at least one support post engageable by the tongue portion of the drawer guide.

2. Description of the Prior Art

In cabinets or similar furniture articles of a type commonly referred to as a peninsula cabinet or an island cabinet for use, for example, in a room such as a kitchen, the cabinet may be provided with drawer openings at corresponding locations on opposite sides of the cabinet. For economy of space, such cabinets are often dimensioned to accommodate only a single drawer inserted into the opening on one of the two opposite sides. The particular shape and layout of the room and the position of other cabinets, furniture, furnishings, equipment and the like dictate on which side of the cabinet the drawer openings are used to receive drawers. The unused drawer openings on the opposite side of the cabinet must then be covered, for example, with an aesthetically pleasing false drawer front. Such false drawer fronts are commonly permanently affixed to the unused drawer front openings with mechanical fasteners such as nails, braids, screws, or with adhesive materials and the like.

Moreover, in order to provide support for the moveable drawer structure, it is necessary to install a drawer guide in the cabinet. A type of drawer guide in common use is attached to the cabinet at one end of the drawer guide at or near the drawer front opening and has at its opposite end a bent tongue portion which is received and supported by a bracket affixed to the back wall of the cabinet opposite the drawer front opening. In a peninsula cabinet or an island cabinet of the type described, it is necessary to position and affix such a mounting bracket on the inside surface of the false drawer front which is mounted on the unused drawer front opening.

If at a later time, the layout of the particular room is changed or if other cabinets, furniture, furnishings, equipment or the like are repositioned within the room, it may be necessary or desirable to reposition the drawers from one side of the cabinet to the other side. If so, it is very difficult to remove the permanently affixed false drawer fronts and reposition them to the other side of the cabinet. Accordingly, there is a current need to provide a bracket for mounting a false drawer front which provides an efficient and relatively simple method of attaching a false drawer front to a false drawer front opening in such a way that it can be easily removed and repositioned at a later time and which at the same time furnishes a prepositioned support for the tongue portion of a drawer guide. The present invention addresses this need and also eliminates the need for a separate drawer guide mounting bracket.

SUMMARY OF THE INVENTION

The general purpose of the present invention, which will be described subsequently in greater detail, is to provide a new and improved bracket for mounting a false drawer front on a cabinet or similar furniture article accommodating easy removal of the false drawer front from one side of the cabinet and repositioning the false drawer front on the other side of the cabinet and at the same time providing a prepositioned support for the tongue portion of a drawer guide.

To attain this purpose, a representative embodiment of the present invention is illustrated in the drawings. The bracket of the present invention makes use of a base which is attachable to a false drawer front and which carries an upstanding leg resiliently connected to the base. The upstanding leg is provided with a locking projection lockable in the false drawer front opening. The locking projection includes a sliding surface and an associated locking surface. The sliding surface is slidably receivable by the false drawer front opening to a locking position of the locking surface in the false drawer front opening. The base also carries an upstanding support element including at least one support post engageable by the tongue portion of a drawer guide.

A drawer guide of the type with which the mounting bracket of the present invention is intended for use is fastened by one or more fastening screws to the cabinet or similar furniture article at the end of the drawer guide opposite the drawer guide tongue portion. Accordingly, when the drawer guide is installed with its opposite end fastened, the support post carried by the base of the bracket of the present invention and supported drawer guide tongue portion cannot pull away from the cabinet or similar furniture article. Thus, it is not necessary that the drawer guide tongue portion be fastened or otherwise secured to the support post, but only that the drawer guide tongue portion be engaged and supported by the support post.

In the bracket of the present invention, the support post of the support element carried by the base of the bracket is received in an opening formed in the tongue portion and supports the tongue portion of the drawer guide. Additional support can be provided with a second support post of the support element likewise received in an opening formed in the tongue portion of the drawer guide.

Moreover, proper positioning of the false drawer front on the false drawer front opening can be accomplished by at least one positioning member upstanding from the base of the bracket which engages the false drawer front opening. At the same time, the positioning member serves to support the bracket and attached false drawer front in the false drawer front opening.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be understood that the phraseology and terminology employed herein are for the purpose of description and are not to be regarded as limiting. Those skilled in the art will appreciate that the conception upon which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved bracket for mounting a false drawer front and supporting a drawer guide in a cabinet or similar furniture article which has all of the advantages, and more, of prior art devices and none of the disadvantages.

It is another object of the present invention to provide a new and improved design of the type described that is more reliable and functional than those presently available.

Yet another object of the present invention is to provide a bracket of the type described that enables repeated removal, relocation and reattachment of the false drawer front to the cabinet or similar furniture article and yet functions reliably and efficiently thereafter.

Still another object of the present invention is to provide a bracket of the type described for mounting a false drawer front and, at the same time, supporting the tongue portion of a drawer guide in the cabinet or similar furniture article without the necessity of a separate mounting bracket for the drawer guide tongue portion.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views,

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 6:
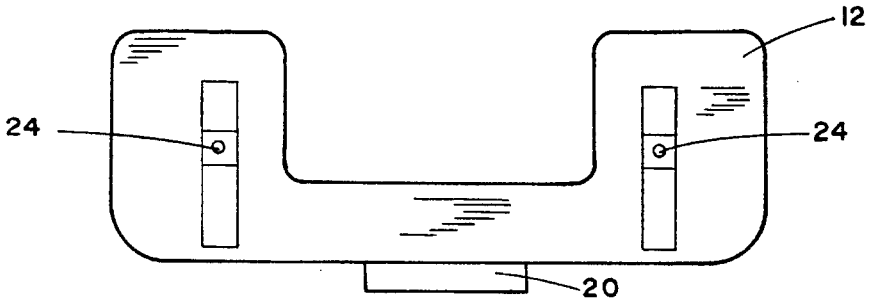
FIG. 6 is a bottom view of the bracket shown in FIGS. 1 through 5.
Figure 5:
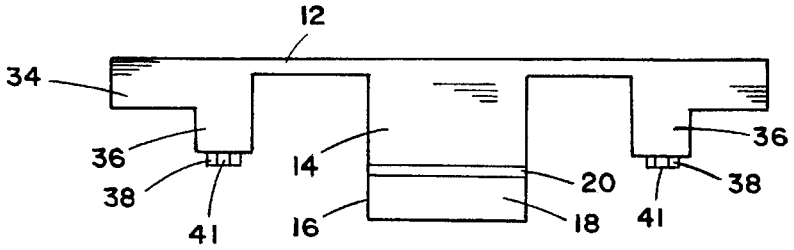
FIG. 5 is a rear elevational view of the bracket shown in FIGS. 1 through 4.
Figure 3:
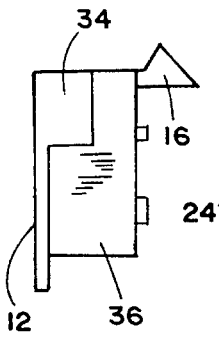
FIG. 3 is a left side elevational view of the bracket shown in FIGS. 1 and 2.
Figure 1:
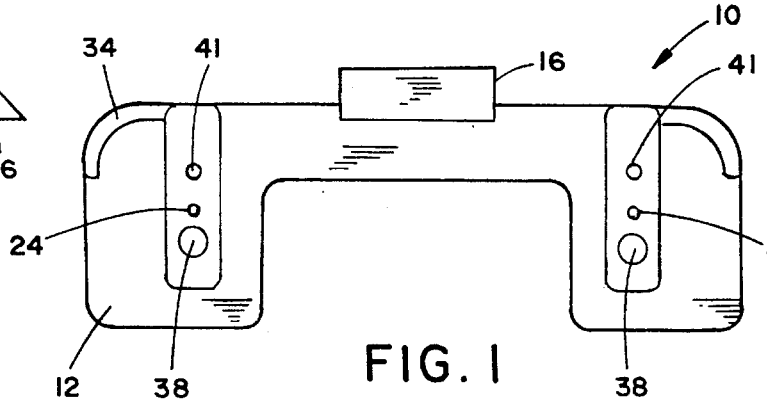
FIG. 1 is a plan view of the bracket comprising the present invention.
Figure 2:
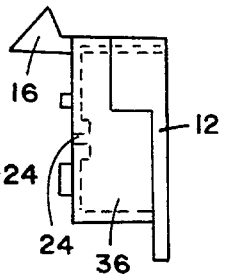
FIG. 2 is a right side elevational view of the bracket shown
Figure 4:
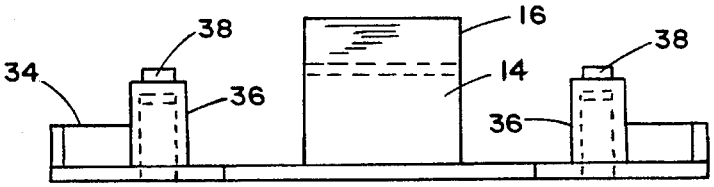
FIG. 4 is a front elevational view of the bracket shown in FIGS. 1 through 3.
Figure 7:
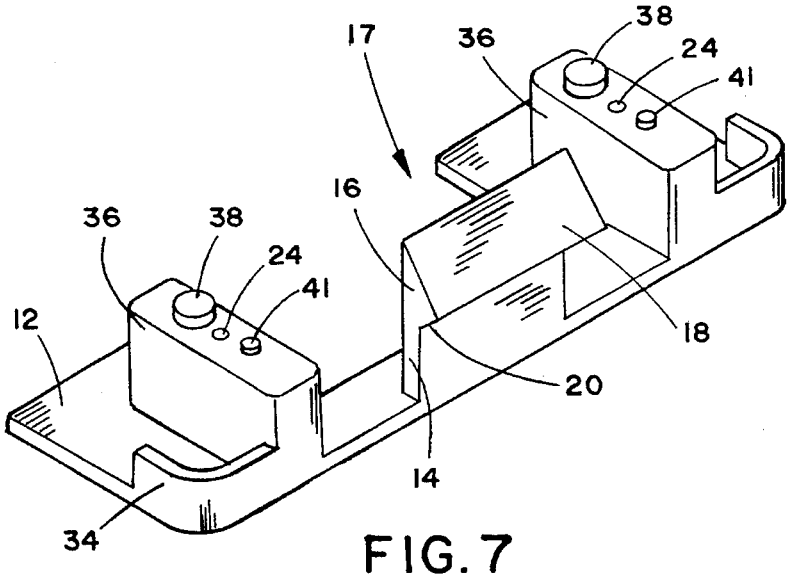
FIG. 7 is a perspective view of the bracket shown in FIGS. 1 through 6.

Referring now to the drawings, and specifically to FIGS. 1–7, a mounting bracket shown generally as 10 has a base 12 and an engaging member shown generally as 17 in FIG. 7. Engaging member 17 includes upstanding leg 14 resiliently connected to base 12, and leg 14 has a locking projection 16 which includes a sliding surface 18 and a locking surface 20. Sliding surface 18 is inclined downwardly from the top of leg 14 toward locking surface 20, and locking surface 20 is inclined downwardly from sliding surface 18 toward base 12.

Figure 8:
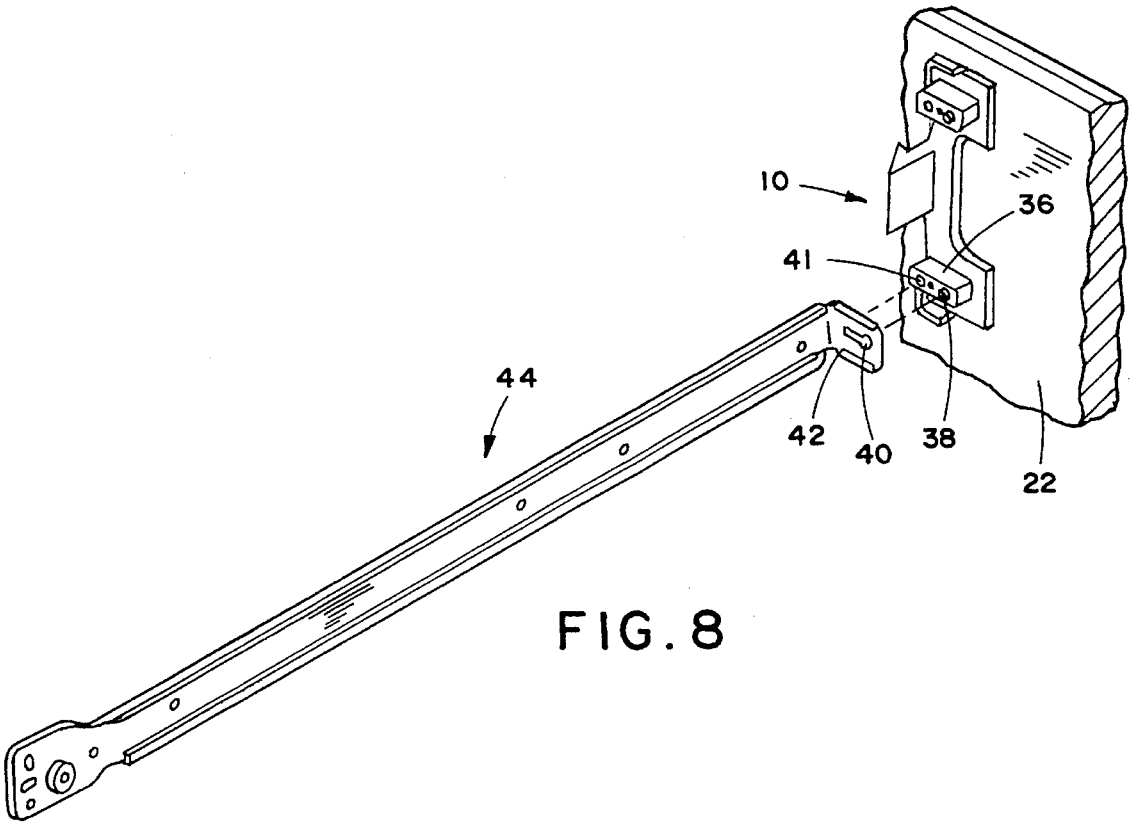
FIG. 8 is a perspective and fragmentary view of a drawer guide having a bent tongue that is cooperatively engageable by the support posts of the bracket shown in FIGS. 1 through 7.
Figure 10:
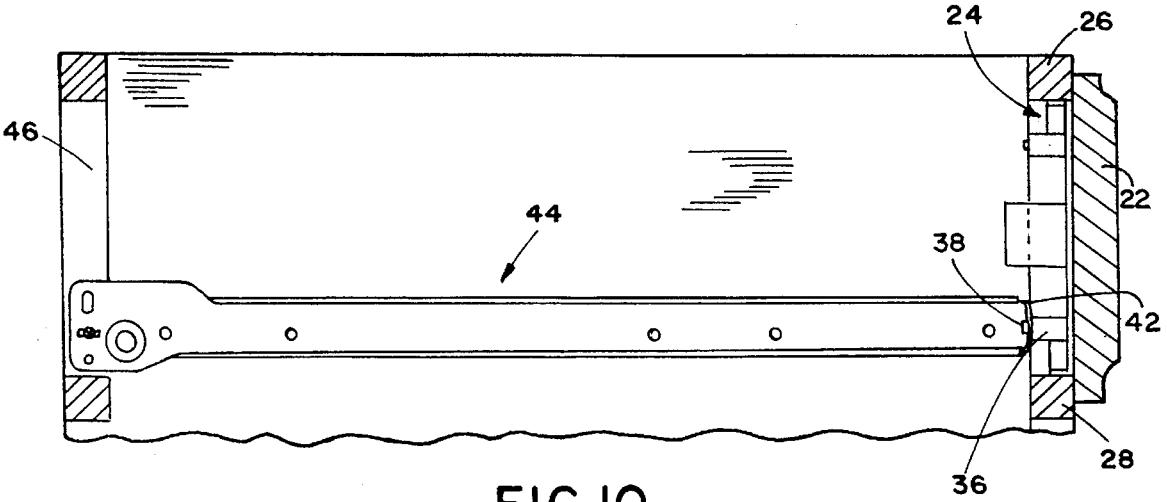
FIG. 10 is a fragmentary view of a drawer guide mounted within a cabinet and having a tongue portion supported by the bracket shown in FIG. 1 through 7 attached to a false drawer front mounted in a false drawer front opening.
Figure 9:
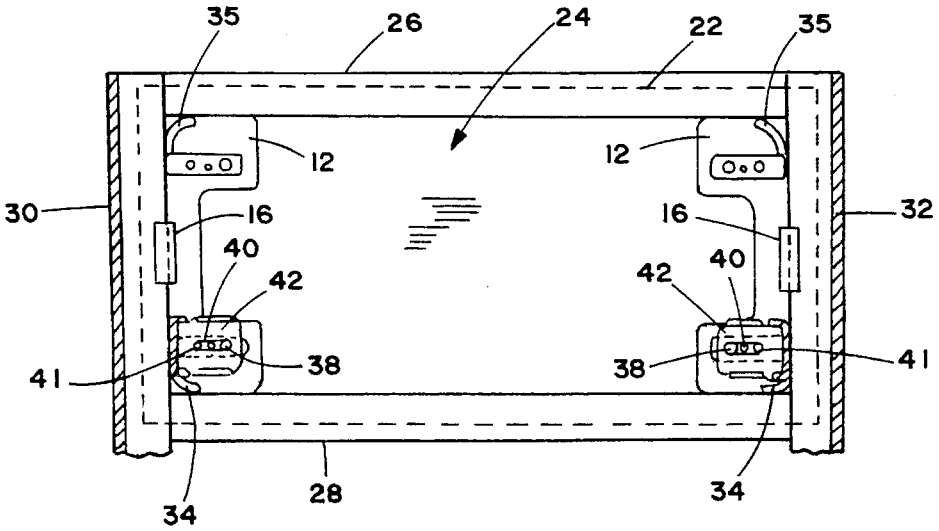
FIG. 9 is a fragmentary view of a pair of the bracket shown in FIGS. 1 through 7 attached to a false drawer front mounted in a false drawer front opening with the support posts of the bracket cooperatively engaged by the tongue portion of a drawer guide.

Referring to FIGS. 8–10, bracket 10 is attachable to a false drawer front 22 by means of mechanical connectors such as nails, braids, screws or the like inserted through channels 24 formed in bracket 10. False drawer front 22 with attached bracket 10 is mountable on a false drawer front opening 24 defined by top and bottom cabinet frame members 26, 28 and opposing side cabinet frame members 30, 32 as shown at FIG. 9. Sliding surface 18 of projection 16 is slidably receivable by one of side frame members 30, 32 to a locking position of locking surface 20 behind one of side frame members 30, 32.

While leg 14 with locking projection 16 provides positioning and support for bracket 10 in false drawer front opening 24, additional positioning and support for bracket 10 in false drawer front opening 24 is furnished by positioning member 34 upstanding from base 12 of bracket 10 engageable in opening 24 as shown in FIG. 9. While such additional support can be furnished by a single positioning member 34 resting against bottom frame member 28 as shown in FIG. 9, an additional positioning member 35 is provided on bracket 10 so that bracket 10 is interchangeable for use on either end of false drawer front 22. Bracket 10 may be dimensioned equal to the distance between top and bottom frame members 26, 28 or less than the distance between top and bottom frame member 26, 28 in order for bracket 10 to be received between top and bottom frame members 26, 28.

Normally, bracket 10 is attached at or near each of the opposing ends of false drawer front 22 to cooperatively engage side frame members 30, 32 as shown in FIG. 9. False drawer front 22 is mounted on defined opening 24 by pressing sliding surfaces 18 of respective engaging members 17 against side frame members 30, 32, deflecting respective engaging members 17 away from side frame members 30, 32 until sliding surfaces 18 clear side frame members 30, 32, allowing engaging members 17 to snap elastically back into an upright position, with respective locking surfaces 20 engaged behind respective side frame members 30, 32.

Referring to FIGS. 7 and 8, base 12 of bracket 10 also carries at least one support element 36 having at least one support post 38 engageable by an opening 40 formed in tongue portion 42 of drawer guide shown generally as 44 in FIG. 8. For additional support and stability, a second support post 41 can be provided on support element 36 likewise engageable in opening 40 of drawer guide 44. Bracket 10 is provided with a pair of support elements 36 with corresponding support posts 38, 41 to enable interchangeable use of bracket 10 on either end of false drawer front 22, as shown in FIG. 9. Engaged drawer guide 44 is fastened to the cabinet or similar furniture article at its end opposite tongue portion 42 as shown in FIG. 10. When drawer guide 44 is so fastened, tongue portion 42 of drawer guide 44 cannot pull away from bracket 10 to disengage tongue portion 42 from support element 36. Moreover, support element 36 is positioned on base 12 of bracket 10 mounted in false drawer front opening 24 in predetermined horizontal alignment with opposing drawer opening 46 of the cabinet as shown in FIG. 10 to provide substantially horizontal alignment of installed drawer guide 44.

Obviously, any number of materials may be used to form the bracket and its components described herein, but exceptional success has been experienced by the use of semi-rigid plastic materials for the base and its components.

With respect to the description set forth above, optional dimensional relationship for the parts of the invention (to include variations in size, materials, shape, form, function, and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A bracket for use in a furniture article having a false drawer front and a drawer guide, comprising:

a base including means for attaching the base to the false drawer front;

the base also including means for mounting the base on the furniture article, said mounting means comprising an engaging member upstanding from said base for engaging the furniture article, said engaging member comprising a leg resiliently connected to said base and having portions defining a locking protection for locking in the furniture article; and the base further including means for supporting the drawer guide.

2. The bracket as claimed in claim 1, said locking projection including a sliding surface and an associated locking surface, said sliding surface being adapted for slideably inserting in the furniture article and said locking surface being adapted for locking in the furniture article.

3. The bracket as claimed in claim 2, said mounting means further comprising at least one positioning member upstanding from said base and being adapted to engage the furniture article.

4. The bracket as claimed in claim 3, said supporting means comprising at least one support element upstanding from said base for receiving and supporting said drawer guide.

5. The bracket as claimed in claim 4, said support element comprising at least one support post for engaging said drawer guide.

6. The bracket as claimed in claim 5, said support element further comprising a second support post, said support posts being adapted for cooperatively engaging said drawer guide.

7. The bracket as claimed in claim 1, said supporting means comprising at least one support element upstanding from said base for receiving and supporting said drawer guide, said support element comprising at least one support post for engaging said drawer guide, and said support element further comprising a second support post, said support posts being adapted for cooperatively engaging the drawer guide.

8. The bracket as claimed in claim 7, said locking projection including a sliding surface and an associated locking surface, said sliding surface being adapted for slideably inserting in the furniture article and said locking surface being adapted for locking in the furniture article.

9. The bracket as claimed in claim 8, said mounting means further comprising at least one positioning member upstanding from said base engageable by the defined opening.

10. The bracket as claimed in claim 9, said mounting means further comprising a second positioning member upstanding from said base, said positioning members cooperatively engageable by the defined opening.

* * * * *